US009922743B2

(12) United States Patent
Lambert et al.

(10) Patent No.: US 9,922,743 B2
(45) Date of Patent: Mar. 20, 2018

(54) DEVICE FOR PRODUCING RADIOISOTOPES

(75) Inventors: Bernard Lambert, Leesburg, VA (US); Jean-Michel Geets, Couthuin (BE); Andrea Cambriani, Strasbourg (FR); Michel Degeyter, Nivelles (BE); Maxim Kiselev, Broadlands, VA (US)

(73) Assignee: Ion Beam Applications S.A., Louvain-la-Neuve (BE)

( * ) Notice: Subject to any disclaimer, the term of this patent is extended or adjusted under 35 U.S.C. 154(b) by 593 days.

(21) Appl. No.: 13/881,305

(22) PCT Filed: Oct. 27, 2011

(86) PCT No.: PCT/EP2011/068876

§ 371 (c)(1),
(2), (4) Date: Jun. 12, 2013

(87) PCT Pub. No.: WO2012/055970

PCT Pub. Date: May 3, 2012

(65) Prior Publication Data

US 2013/0266105 A1 Oct. 10, 2013

(30) Foreign Application Priority Data

Oct. 27, 2010 (BE) ..... 2010/0640

(51) Int. Cl.
*G21G 1/10* (2006.01)
*G21G 4/04* (2006.01)
(Continued)

(52) U.S. Cl.
CPC ..... *G21G 4/04* (2013.01); *G21G 1/10* (2013.01); *H05H 6/00* (2013.01); *G21G 2001/0015* (2013.01)

(58) Field of Classification Search
CPC ..... G21G 4/04; G21G 1/10; H05H 6/00
(Continued)

(56) References Cited

U.S. PATENT DOCUMENTS 5,917,874 A * 6/1999 Schlyer ..... H05H 6/00 376/190
6,586,747 B1 7/2003 Erdman
(Continued)

FOREIGN PATENT DOCUMENTS

| | | | |
|---|---|---|---|
| BE | 1011263 | A6 | 6/1999 |
| EP | 1569243 | A1 | 8/2005 |
| WO | 2005/081263 | A2 | 9/2005 |

OTHER PUBLICATIONS

Firouzbakht et al. "Mechanism of Nitrogen-13-Labeled Ammonia Formation in a Cryogenic Water Target." Nuclear Medicine & Biology, 199, vol. 26, pp. 437-441.*
(Continued)

*Primary Examiner* — Jack W Keith
*Assistant Examiner* — Lily C Garner
(74) *Attorney, Agent, or Firm* — Finnegan, Henderson, Farabow, Garrett & Dunner LLP

(57) ABSTRACT

The invention relates to a device (1) for producing radioisotopes by irradiating a target fluid using a particle beam (13). This device comprises an irradiation cell (7) that includes a cavity (3) for receiving the target fluid. A non-cryogenic cooling device cools the walls of the cavity (3). The cavity (3) has an inclined surface (15) downwardly delimiting the cavity (3) so as to evacuate the target fluid, which condenses on contact with the cooled walls, under gravity towards a metal foil (4) which closes off this cavity (3). The inclined surface (15) intersects the plane formed by the metal foil (4), making an acute angle (a) with said plane, so as to form with the metal foil (4) a wedge-shaped zone (18) capable of collecting, by gravity, the condensed target fluid.

17 Claims, 4 Drawing Sheets

(51) Int. Cl.
*H05H 6/00* (2006.01)
*G21G 1/00* (2006.01)

(58) Field of Classification Search
USPC ..... 376/190
See application file for complete search history.

(56) References Cited

U.S. PATENT DOCUMENTS

| | | | | |
|---|---|---|---|---|
| 8,288,736 | B2 * | 10/2012 | Amelia | G21G 1/00 250/428 |
| 2005/0084055 | A1 | 4/2005 | Alvord et al. | |
| 2006/0062342 | A1 | 3/2006 | Gonzalez Lepera et al. | |
| 2006/0104401 | A1 * | 5/2006 | Jongen | G21G 1/10 376/190 |

OTHER PUBLICATIONS

Kakavand et al. "Computer Simulation Techniques to Design Xenon-124 Solid Target for Iodine-123 Production." Iran. J. Radiat. Res., 2008; vol. 5, No. 4, pp. 207-212.*

NIST Cryogenics Technology Group. "About Cryogenics." 2002. available online: <http://www.cryogenics.nist.gov/AboutCryogenics/about%20cryogenics.htm>.*

Papadopoulos, A. M., and C. J. Koroneos. "Refrigeration and Cryogenic systems." Air Conditioning—Energy Consumption and Environmental Quality8 (2009): 310.*

Nash, J. M. "Vortex expansion devices for high temperature cryogenics."IECEC'91; Proceedings of the 26th Intersociety Energy Conversion Engineering Conference, vol. 4. vol. 4. 1991.*

Thompson, Zachary J. An Automated System for Cryo-Electron Microscopy Sample Preparation. Diss. Rice University, 2011.*

International Search Report, International Patent Application No. PCT/EP2011/068876, date of completion Nov. 30, 2011, 3 pages.

Mahmoud L. Firouzbakht et al., "Mechanism of Nitrogen-13-Labeled Ammonia Formation in a Cryogenic Water Target." Nuclear Medicine & Biology, 1999, vol. 26, pp. 437-441.

Mahmoud L. Firouzbakht et al., "Cryogenic Target Design Considerations for the Production of [18F]Fluoride From Enriched [18O]Carbon Dioxide." Nuclear Medicine & Biology, 1999, vol. 26, pp. 749-753.

T. Kakavand et al., "Computer Simulation Techniques to Design Xenon-124 Solid Target for Iodine-123 Production." Iran. J. Radiat. Res., 2008; vol. 5, No. 4, pp. 207-212.

* cited by examiner

DEVICE FOR PRODUCING RADIOISOTOPES

CROSS REFERENCE TO RELATED APPLICATIONS

This application is a national phase application of International Application No. PCT/EP2011/068876, filed Oct. 27, 2011, designating the United States and claiming priority to Belgium Patent Application No. 2010/0640, filed Oct. 27, 2010, both of which are incorporated by reference as if fully rewritten herein.

TECHNICAL FIELD

The present invention generally relates to a device for producing radioisotopes, and more particularly a device for producing radioisotopes through radiation using a particle beam of a target fluid comprising a radioisotope precursor. It also relates to an irradiation cell designed to produce radioisotopes through irradiation using a particle beam of a target fluid comprising a radioisotope precursor.

BACKGROUND OF THE INVENTION

In nuclear medicine, positron emission tomography is an imaging technique requiring radioisotopes imaging positrons or molecules marked by those same radioisotopes. $^{18}F$ is one of the most commonly used radioisotopes from among others such as $^{13}N$, $^{15}O$ or $^{11}C$. $^{18}F$ has a half-life time of 109.6 min. and can thus be conveyed toward sites other than its production site.

$^{18}F$ is most often produced in its ionic form and obtained by accelerated proton bombardment on an irradiation cell comprising $^{18}O$-enriched water. Many irradiation cells have been developed that all have the same purpose of producing $^{18}F$ in a shorter period of time with a better yield. Generally, the production of radioisotopes comprises a proton accelerator and an irradiation cell. This irradiation cell comprises a cavity, inside which the radioisotope precursor in liquid form is included.

Generally, the energy from the proton beam directed on the irradiation cell is approximately from several MeV to approximately 20 MeV. Such a beam energy causes heating of the irradiation cell as well as vaporization of the radioisotope precursor, thereby decreasing the stopping power of that precursor and therefore the radioisotope production yield. A device cooling the target must therefore also be used so as to try to keep the radioisotope precursor in liquid form, or at most in an intermediate state between liquid and vapor. Furthermore, in the case of $^{18}F$ production, due to the particularly high cost of the precursor, $^{18}O$-enriched water, only a very small volume of that precursor, at most several milliliters, can be placed in the irradiation cell. Consequently, the issue of heat dissipation produced by the irradiation of the target material on such a small volume is a major problem to be overcome. Typically, the power to be dissipated for an energy beam of 18 MeV with an intensity from 50 to 100 μA is between 900 W and 2,700 W, over a radioisotope precursor volume generally comprised between 0.2 and 5 ml, for irradiation times from several minutes to several hours.

Document U.S. Pat. No. 5,917,874 describes a radioisotope production device comprising an irradiation cell closed by a metal foil and comprising a fluid comprising a radioisotope precursor or target fluid. The depth of the cavity of the irradiation cell with respect to the axis of the beam is relatively small so as to irradiate substantially the entire target fluid sample. In one preferred usage example of that document, the depth of the cavity of the irradiation cell is 1.7 mm, so as to have an optimal working cross-section to produce radioisotopes. The energy from the particle beam irradiating the target fluid is approximately 8 MeV, which requires a thin enough metal foil to limit energy losses of the beam when the latter passes through the foil. In the cited document, the foil has a thickness of approximately 6 microns and is held by a perforated grid so as to bear the increasing internal pressure in the irradiation cell during irradiation. The radioisotope production device also comprises means for cooling the irradiation cell. The irradiation cell can be inserted into a cooling housing in which a stream of water circulates. The irradiation cell also comprises a solid column made from a material with a high heat conductivity and situated on the rear side of the irradiation cell, across from the foil, so as to evacuate the heat produced in the cavity. The inside of the cooling housing is cylindrical and comprises a conduit situated across from the apex of said cone and designed to project a turbulent flow of cold water on the cone. The cone also has fins spaced radially around the surface thereof, so as to improve the evacuation of the heat. Such a device only enables the irradiation of small volumes of $^{18}O$-enriched water, and does not have the means making it possible to effectively cool the metal foil, which can be problematic in terms of the sealing of the irradiation cell. Furthermore, the perforated grid is not completely transparent to the beam and prevents part of the beam from penetrating inside the cavity. Part of the perforated grid or the metal foil therefore absorbs part of the beam, which causes heating of the metal foil. The metal foil being relatively thin and being the most heated and least well-cooled part, it is relatively fragile. Furthermore, the seals situated between the latter and the body are damaged during use and said cavity loses sealing.

Document BE 1011263 describes a radioisotope production device comprising an irradiation cell with a cavity comprising a hemispherical part, closed by a foil. The irradiation cell receives a fluid comprising a radioisotope precursor also called "target fluid." The walls of this cavity are made from a heat-conducting metal material and with a thin enough thickness to dissipate the heat from the inside of the cavity. An element called a "diffuser" surrounds the outer walls of said cavity, creating a channel in which a coolant circulates. Nevertheless, the irradiation cell must have a minimal depth so as to sufficiently irradiate target fluid without beam losses in the body of the irradiation cell. In order to increase the depth of the cavity without significantly increasing the volume of the cell so as to minimize the quantity of $^{18}O$ inside the cell, an irradiation cell as described in document WO 2005081263 has been produced. This irradiation cell comprises a first cylindrical part and a second hemispherical part situated on the side opposite a foil closing the cavity. A first drawback of this type of device is that when the irradiation cell is irradiated, a large portion of the fluid comprised in the cavity vaporizes, leaving only a thin net of water on the lower wall of the cavity. The particle beam passing through a low-density volume, the likelihoods of $^{18}O(p,n)^{18}F$ nuclear reactions are decreased. Furthermore, the walls of the cavity being relatively thin and undergoing significant heating, said cavity collapses after several uses, which positions part of the liquid, which is already not very irradiated, outside the beam and causes a drop in yield.

Document US 20050084055 describes a radioisotope production device comprising an irradiation cell comprising a target fluid. The irradiation cell comprises a cavity closed by a foil. The cavity comprises a face opposite said foil and called "rear wall," as well as an upper wall situated at the top of the foil and the rear wall. The rear wall is inclined such that the part of the rear wall proximal to the upper wall is further from the foil than the part of the rear wall distal to the upper wall. The device also comprises a cooling system comprising a vertical conduit 502 through which a coolant arrives. The vertical conduit 502 is connected to a conduit 504 and adjacent to the rear wall, which in turn is connected to a conduit 506 adjacent the upper wall. In this device, the lower wall separating said surface from the part of the rear wall distal to the upper wall is not cooled. Furthermore, the cooled walls are only cooled by a conduit in contact with part of the walls. Lastly, the fluid present in the cavity condenses on the cooled upper wall through a liquid having been heated after having passed through the conduit 504 and adjacent to the rear wall. The cooling of the fluid comprised in the cavity is therefore not optimal and must be improved so as to have more condensed liquid across from the beam so as to increase the probabilities of nuclear reactions.

With the aim of reducing the mechanical stresses on the foil due to the increase in pressure in the cavity during irradiation, document U.S. Pat. No. 6,586,747 describes a radioisotope production device comprising an irradiation cell comprising a cavity closed by a foil that is inclined relative to the axis of the beam. In this way, the power of the beam is distributed over a larger area. Nevertheless, in this device, with the increase in the area of the foil exposed to the beam, the power of the beam dissipated in the foil nevertheless remains high, which causes overall heating of the foil and an increase in the inner pressure in the cavity.

Document US 20060062342 aims to resolve the problem of pressure stresses on the foil by introducing a pressurized chamber adjacent to the foil of the irradiation cell, such that the pressure exerted on the foil on the side of the pressurization chamber opposes the pressure exerted on the same foil on the side of the irradiation cell. The incline or perpendicular position relative to the beam of the target chamber foil should make it possible to force the target fluid under the apex of the foil. Nevertheless, the device does not comprise a system for cooling the foil, and the addition of a pressurized chamber and therefore additional foil in the passage of the beam causes power losses of the beam. The foil being poorly cooled, it is difficult to force the fluid against the apex of said foil.

The document FIROUZBAKHT M. L. et al, "Mechanism of nitrogen-13-labeled ammonia formation in a cryogenic water target—Target design, products and operating parameters," Nuclear Medicine and Biology, ELSEVIER, N.Y. vol. 26, no. 4, May 1, 1999, pages 437-441, describes a target with a conical cavity cooled by a cryogenic liquid. The foil forming the irradiation window is separated from the conical cavity by an annular channel that serves to collect, through gravity, at the lowest level, the liquid the condenses on the walls of the cavity.

The document FIROUZBAKHT M. L. et al, "Cryogenic target design considerations for the production of [$^{18}$F] fluoride from enriched [$^{18}$O] carbon dioxide," Nuclear Medicine and Biology, ELSEVIER, N.Y., vol. 26, no. 7, Oct. 1, 1999, pages 749-753, also describes targets cooled by a cryogenic liquid. The cavity of the target of FIG. 1 comprises a cylindrical part extended by a conical part. The metal foil forming the irradiation window closes the cylindrical part of the cavity. A target of the same type is also described in the document by T. KAKAVAND et al., "Computer simulation techniques to design Xenon-124 solid target for iodine-123 production," IRANIAN JOURNAL RADIATION RESEARCH, vol. 5, no. 4, 2008, pages 207-212.

It will be noted that cryogenic cooling targets cause fewer problems regarding cooling of the cell and the metal foil forming the irradiation window. They do, however, require finding gaskets that withstand cryogenic temperatures and, at the same time, have a sufficient lifetime when exposed to intense irradiation.

In order to increase the radioisotope production yields, it is necessary to provide a radioisotope production device that does not comprise the drawbacks of the prior art.

In particular, it is necessary to provide effective means for cooling the window closing the target cavity, particularly when working with a non-cryogenic coolant.

It is also necessary to improve the cooling device for the walls of the target cavity.

Other advantages and properties of the device according to the invention will be shown in light of the following description.

BRIEF DESCRIPTION OF THE INVENTION

According to a first aspect, the present invention relates to a device designed to produce radioisotopes through the irradiation of a target fluid comprising a radioisotope precursor using a particle beam, the device comprising:

- an irradiation cell comprising a cavity designed to contain the target fluid and closed by a metal foil; and
- a non-cryogenic cooling device for the walls of the cavity, capable of keeping at least one fraction (preferably all) of the target fluid comprised in the cavity in a liquid state when the target fluid is irradiated.

The cavity comprises an inclined surface 15, defining the bottom of the cavity, so as to evacuate the target fluid, which condenses in contact with the walls of the cavity that are cooled by the cooling device, by gravity toward the metal foil. The inclined surface intersects the plane formed by the metal foil forming an acute angle ($\alpha$) with the plane, so as to form, with the metal foil, a corner-shaped area capable of collecting the condensed target fluid by gravity. Due to the corner shape of that area, the height of the fluid collected therein is maximal at the metal foil and decreases moving away from the latter. This corner-shaped area ensures good cooling of the metal foil, in particular guaranteeing a maximum height of the fluid at the metal foil. The corner shape further reduces the risk of local overheating of the fluid, owing to excellent circulation of the fluid in that area by convection.

Preferably, the metal foil is positioned substantially perpendicular to the axis of the particle beam.

Preferably, the radioisotopes are produced by irradiating a target fluid using a substantially horizontal particle beam. Preferably, the plane formed by the metal foil is a vertical plane.

Preferably, the acute angle ($\alpha$) is comprised between (approximately) 30° and (approximately) 89°, preferably between (approximately) 45° and (approximately) 85°, still more preferably between (approximately) 60° and (approximately) 85°.

Preferably, the cooling device comprises a coolant intake situated across from the part of the irradiation cell opposite said foil, and a diffuser creating a channel capable of circulating the coolant.

The inclined surface may for example be a plane or surface made up of several planes or a curved surface or surface made up of several curved surfaces. Preferably, the cavity has a substantially conical shape, and preferably over the largest part of its depth, is in the form of a straight cone of revolution. In this embodiment, the inclined surface is then a concave surface of a cone, and the corner-shaped area is defined by a cone surface, the plane formed by the metal foil, and a horizontal plane intercepting the cone surface and the plane formed by the metal foil.

Preferably, the apex of the substantially conical cavity is rounded, and is preferably in the form of the spherical cap.

Preferably, the irradiation cell comprises:

- a first part comprising a front surface, which forms a bearing surface for the metal foil, and a rear surface;
- a second, substantially conical part, which protrudes relative to the rear surface of the first part.
- A conical cavity designed to contain the target fluid passes through the first part to extend into the second part, and forms, in the front surface of the first part, an opening defined by an edge, such that the metal foil closes the opening at the edge when it bears on the front surface of the first part.

Preferably, the first part further comprises a groove surrounding the second part on the side of the rear surface, said groove being designed to serve as a collector for a coolant flowing along the outer surface of said second part.

Preferably, the irradiation cell is made from niobium.

Preferably, the outer surface of the second substantially conical part comprises furrows, preferably extending from an area close to the apex of the second part toward a region close to the base of the second part, so as to create pathways for the passage of said coolant flowing along the outer surface of said second part.

According to another aspect, the present invention relates to an irradiation cell designed to produce radioisotopes by irradiating a target fluid comprising a radioisotope precursor using a particle beam, the cell comprising:

- a first part comprising a front surface, which forms a bearing surface for a metal foil, and a rear surface; and
- a second, substantially conical part, which protrudes relative to the rear surface of the first part;
- a substantially conical cavity, designed to contain the target fluid, which passes through the first part to extend into the second part, and which forms, in the front surface of the first part, an opening defined by an edge, such that the metal foil is capable of closing the opening at that edge, when it bears on the front surface of the first part.

Preferably, the first part also comprises a groove, which, on the side of the rear surface, surrounds the outer surface of the second part, so as to reduce the thickness of the first part at the base of the second part, said groove being designed to serve as a collector for a coolant flowing along the outer surface of the second part.

Preferably, the outer surface of the second substantially conical part comprises furrows, each of said furrows preferably extending from an area close to the apex of the second, substantially conical part toward a region near the base of the second part, so as to create pathways between them for the passage of a coolant flowing along the outer surface of the second part.

DETAILED DESCRIPTION OF THE INVENTION

The device according to the present invention is designed to be used in the context of radioisotope production, in particular through irradiation of a target fluid using an accelerated particle beam. One preferred use of the device 1 according to the present invention is the production of $^{18}F$ through bombardment using an accelerated proton beam 13 on $^{18}O$-enriched water. Preferably, the beam 13 is substantially horizontal.

Figure 1:
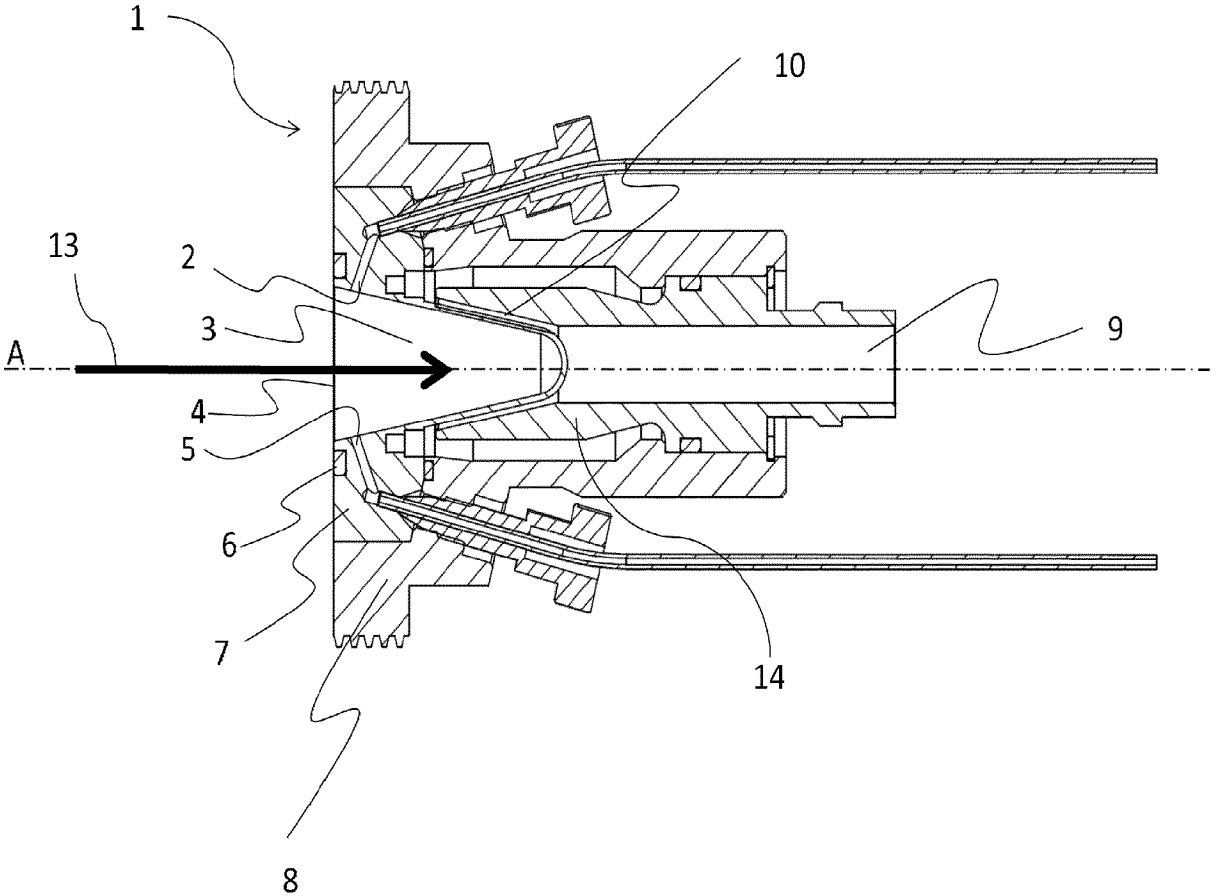
FIG. 1 is a longitudinal cross-section of part of the device according to one embodiment of the present invention.

FIG. 1 shows a longitudinal cross-section of part of the device 1 according to one embodiment of the present invention. The device 1 of the present invention comprises an irradiation cell 7 shown in a three-dimensional view in FIG. 2. The irradiation cell 7 comprises a cavity 3 designed to contain a target fluid, for example 180-enriched water. As indicated in FIG. 3, the cavity 3 has an upper (or top) part 19 (located above the plane A-B) and a lower (or bottom) part 20 (located below the plane A-B). During operation, the plane A-B is substantially horizontal. The cavity 3 comprises an opening at a base 23 of the cavity 3, the opening closed by a metal foil 4 transparent to the beam 13. In the context of the present invention, the expression "foil transparent to the beam" means that substantially all of the beam 13 can pass through the metal foil 4 without being attenuated by the metal foil 4. The metal foil 4 is preferably positioned substantially perpendicular to the axis of the particle beam 13. The metal foil 4 is characterized by an upper (or top) part and a lower (or bottom) part, as shown in FIG. 3, substantially coinciding respectively with the upper (or top) part 19 and the lower (or bottom) part 20 of the cavity 3. The metal foil 4 is kept sealably against the upper surface of the irradiation cell 7. A seal 6 is positioned between the metal foil 4 and the irradiation cell 7, so as to ensure sealing.

FIG. 1 shows that the irradiation cell 7 comprises an inlet channel 2 preferably emerging in the upper part 19 of the cavity 3 and near the metal foil 4 for the introduction of the target fluid into the cavity 3, and an output channel 5 for removing target fluid, preferably beginning in the lower part 20 of the cavity 3. Preferably, the inlet 2 and outlet 5 channels are situated less than 10 mm, still more preferably less than 5 mm, still more preferably less than 3 mm, from the foil 4 such that the filling of the cavity and evacuation of the target fluid are made easier. Advantageously, the irradiation cell 7 comprised in the device 1 according to the present invention is used in a radioisotope production device comprising a loop in which a target fluid can be circulated periodically through the irradiation cell and a cooling and/or capture system for the produced radioisotope, as described in document WO 02101758. In the context of this preferred aspect, the position and the incline of the inlet channel 2 relative to the metal foil 4 are advantageously selected so as to form an additional means for cooling the metal foil 4. The selection of the position and the optimal incline of the inlet channel 2 relative to the foil 4 are well within the skills of one skilled in the art.

The irradiation cell 7 can be inserted into a body 8 comprising a cooling device. The cooling device comprises a coolant inlet 9, preferably a non-cryogenic coolant. The coolant intake 9 is preferably situated along the axis A-B and oriented toward the part of the irradiation cell 7 opposite the foil 4. Preferably, the cooling device also comprises a diffuser 14 creating an annular channel 10 around the irradiation cell 7. The coolant circulating in the channel 10 must ensure that the walls of the irradiation cell 7 are cooled enough for the target fluid comprised in the cavity 3 to remain essentially in liquid form.

The cavity 3 comprises, in the lower part 20 thereof, an inclined surface 15 (here a concave conical surface, since the cavity 3 is preferably substantially conical). This inclined surface 15 delimits the lower part 20 of the cavity at the bottom thereof, so as to evacuate the target fluid, which condenses in contact with the cold walls of the cavity 3 by gravity toward said metal foil 4. It intercepts the plane formed by the metal foil 4 by forming an acute angle ($\alpha$) with that plane, so as to form an area 18 capable of receiving, by gravity, the coolant that (during operation) condenses in contact with the walls of the cavity 3 cooled by the cooling device. Preferably, the acute angle ($\alpha$) is comprised between 30° and 89°, more preferably between 45° and 85°, and still more preferably between 60° and 85°. The inclined surface 15 is in contact with the lower part of the metal foil 4, thereby creating the area 18 of the cavity 3 in contact with the metal foil 4 in which target fluid condensed on the walls of the cavity 3 may accumulate more quickly. FIG. 3 shows that this area 18 is in the shape of a corner, defined between the plane formed by the metal foil 4, the inclined surface 15, which intercepts the plane formed by the metal foil 4 at the edge 22, and a horizontal plane, which intercepts the inclined surface 15 and the plane formed by the metal foil 4. In that area 18, the height of the collective condensed fluid is maximal at the metal foil 4 (i.e., where the fluid is in direct contact with the metal foil 4) and decreases gradually moving away from the metal foil 4 (i.e., toward the inside of the cavity 3). The condensed target fluid in contact with the metal foil 4 in the area 18 of the cavity 3 minimizes heating of the foil and therefore heating of the seals 6, which ensures good sealing of the cavity 3 relative to the devices of the prior art. It will be seen that the corner-shaped area 18 in particular guarantees a maximal height of the liquid at the metal foil. It also reduces the risk of local overheating of the condensed fluid, owing to excellent circulation by convection of the liquid in that area. Likewise, the continuous contribution of condensed target fluid at the walls of the metal foil 4 minimizes the heating of the metal foil 4 and reduces the risk of damage thereof. Consequently, the metal foil 4 being better cooled relative to the foils of the devices of the prior art, the inner pressure in the cavity 3 decreases and it is possible to reduce the thickness of the foil, which limits energy losses of the beam 13 in the metal foil 4.

According to one preferred aspect, the cavity 3 is substantially conical. The conical shape of the cavity makes it possible to maximize the cooled surface $S_r$ relative to the volume of the cavity $V_c$. It has in fact surprisingly been discovered that if the $S_r/V_c$ ratios are compared to the shapes of the cavities of the prior art with that of the present invention, it can be seen that for a given opening radius of the cavity R and depth of the cavity P (FIG. 4), this ratio is higher in the case of a cavity with a substantially conical shape. Tables 1, 2 and 3 below show this comparison.

TABLE 1

| Shape of the cavity | Cone | Cylinder | Hemisphere (BE1011263) | Cylinder (Radius = 2 cm, Height = 2 cm) + Hemisphere (Radius = 2 cm) (WO2005081263) |
|---|---|---|---|---|
| Radius R of the opening of the cavity (cm) | 2 | 2 | 2 | 2 |
| Depth P of the cavity (cm) | 2 | 2 | 2 | 4 |
| Volume Vc of the cavity ($cm^3$) | 8.4 | 25.1 | 16.7 | 41.9 |
| Area of the cooled surface Sr ($cm^2$) | 17.8 | 37.7 | 25.1 | 50.2 |
| Sr/Vc ($cm^{-1}$) | 2.12 | 1.5 | 1.5 | 1.2 |

TABLE 2

| Shape of the cavity | Cone | Cylinder (Radius = 2 cm, Height = 2 cm) + Hemisphere (Radius = 2 cm) (WO2005081263) |
|---|---|---|
| Radius R of the opening of the cavity (cm) | 2 | 2 |
| Depth P of the cavity (cm) | 4 | 4 |
| Volume Vc of the cavity ($cm^3$) | 16.7 | 41.9 |
| Area of the cooled surface Sr ($cm^2$) | 28.1 | 50.2 |
| Sr/Vc ($cm^{-1}$) | 1.7 | 1.2 |

TABLE 3

| Shape of the cavity | Cone | Cylinder (Radius = 2 cm, Height = 2 cm) + Hemisphere (Radius = 2 cm) (WO2005081263) |
|---|---|---|
| Radius R of the opening of the cavity (cm) | 1 | 1 |
| Depth P of the cavity (cm) | 4 | 4 |
| Volume Vc of the cavity ($cm^3$) | 4.2 | 20.9 |
| Area of the cooled surface Sr ($cm^2$) | 12.9 | 25.1 |
| Sr/Vc ($cm^{-1}$) | 3.1 | 1.2 |

Tables 1, 2 and 3 show that for a same depth P of the cavity and a same opening radius R of the cavity, the volume of a conical irradiation cell is always smaller than the volume of an irradiation cell comprising a cylindrical part and a hemispherical part as described in document WO 2005081263. Consequently, for a same depth P of the cavity and a same opening radius R of the cavity, the "area of the cooled surface per unit of volume" ratio Sr/Vc for a conical irradiation cell is always larger than that of an irradiation cell as described in document WO 2005081263. Advantageously, the irradiation cell 7 for use in the device 1 according to the present invention therefore enables the irradiation of a reduced target fluid volume, while keeping the depth of the cavity 3 sufficient to prevent beam losses, and providing improved cooling.

According to another preferred aspect, the irradiation cell is made from niobium, a material chosen for its chemical inertia properties and acceptable thermal properties. Niobium does not produce secondary radioisotopes whereof the half-life time exceeds 24 hours. Niobium nevertheless has the drawback of being difficult to machine, which is why in this preferred aspect, the apex of the cell is preferably rounded.

Figure 4:
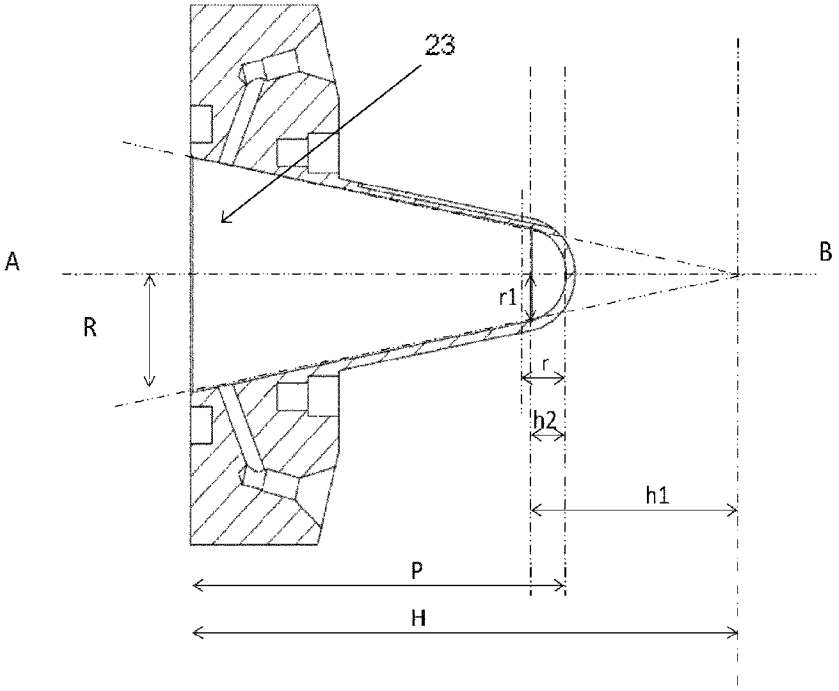
FIG. 4 is a cross-section identical to that of FIG. 3, in which different dimensions of the irradiation cell of FIG. 2 are indicated.

One example embodiment of an irradiation cell made from niobium is shown in FIG. 4. The irradiation cell 7 is in the shape of a cone with height H and radius R. The cone is tapered by a plane parallel to the base of the cone, at height H−h1, where the cone has a radius r1. This tapered part is topped by a spherical cap with radius r and height h2 relative to the base of said disk with radius r1. Advantageously, the depth P of the cavity 3 is greater than the diameter of the opening of the cavity 3, so as to minimize the volume of target fluid, while preserving a sufficient depth to irradiate the target fluid effectively.

According to another preferred aspect, the radius R of the opening of the cavity is comprised between 2 mm and 20 mm, more preferably between 5 mm and 15 mm, and the depth of the cavity is preferably comprised between 1 and 10 cm, more preferably between 1 cm and 5 cm.

According to another preferred aspect, the height h2 of the spherical cap is less than 1 cm.

Figure 2:
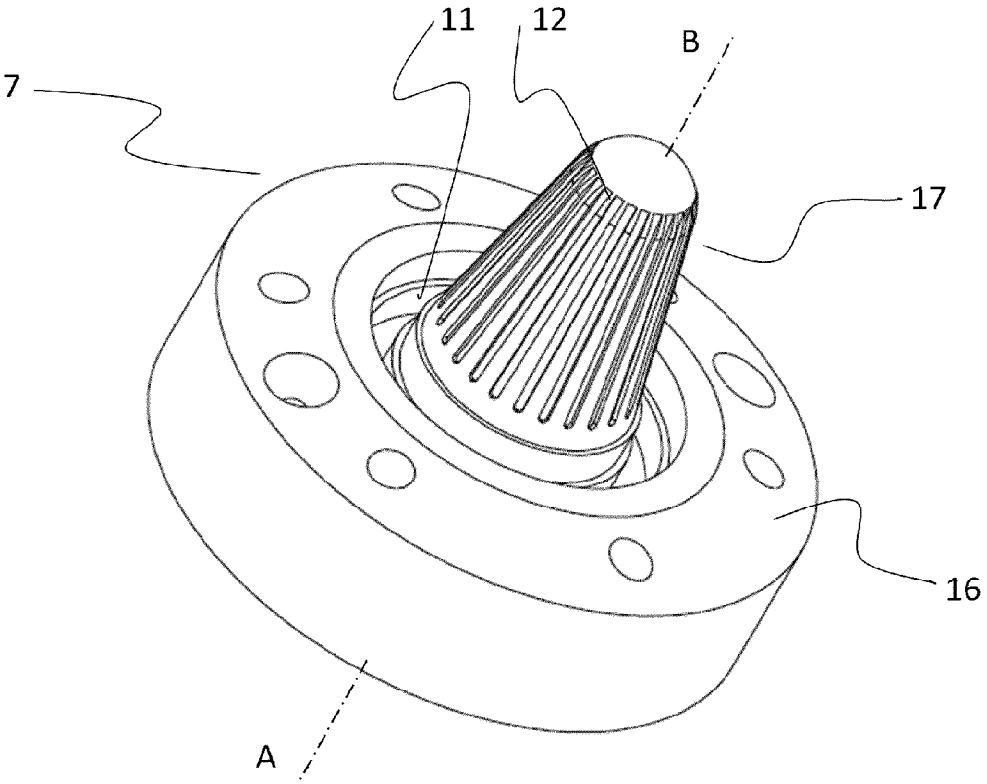
FIG. 2 is a three-dimensional view of an irradiation cell according to one embodiment of the present invention.
Figure 3:
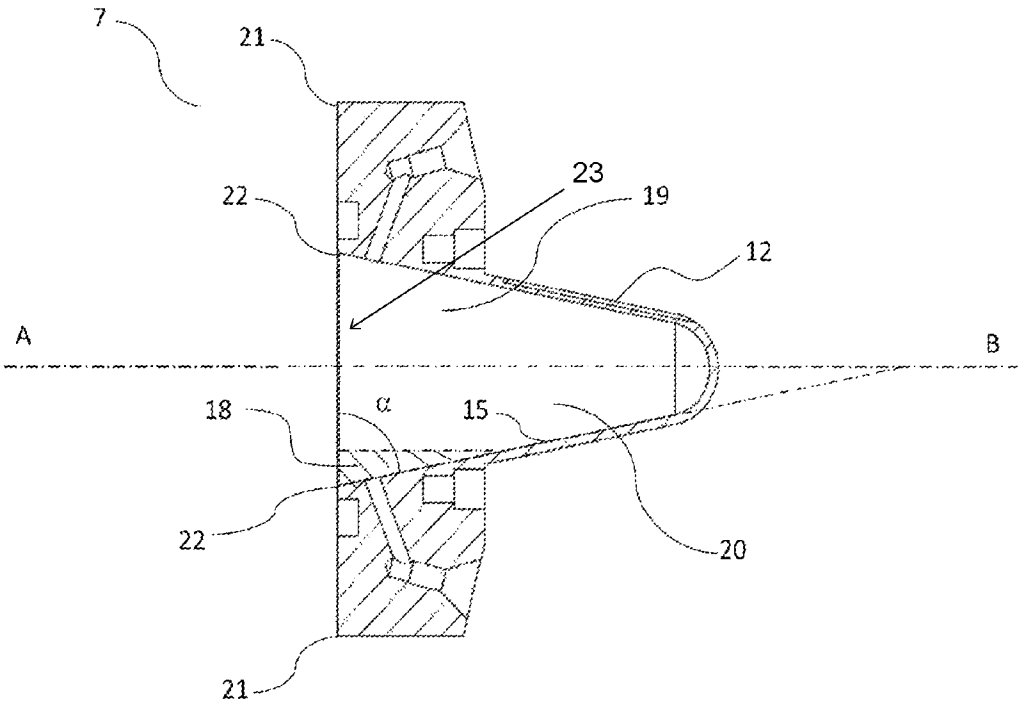
FIG. 3 is a longitudinal cross-section along an axis A-B of the irradiation cell of FIG. 2.

An irradiation cell 7 according to one preferred aspect is shown in FIGS. 2, 3 and 4. The irradiation cell 7 comprises:

- a first part 16 comprising a front surface, which forms a bearing surface for the metal foil 4, and a rear surface; and
- a second, substantially conical part 17, that protrudes relative to said rear surface of said first part 16.

The conical cavity 3 passes through the first part 16 to extend into the second part 17, and forms, in the front surface of the first part 16, an opening delimited by the edge 22, with a circular shape, such that said metal foil 4 closes the opening at the edge 22 when it bears on the front surface of the first part 16.

According to another preferred aspect of the present invention, the outer surface of the second part 17 of the irradiation cell 7 comprises linear furrows 12, each of said furrows 12 preferably extending from a region/area close to the apex of the second substantially conical part 17 toward a region near the base of the second substantially conical part 17, so as to create pathways between them making it possible to accelerate the passage of the coolant 9 and therefore to improve cooling. The addition of the furrows 12 also causes an increase in the outer surface area of the cone and therefore the heat exchange surface area.

According to still another preferred aspect, the first part 16 of the irradiation cell 7 also comprises an annular groove 11 surrounding the second part 17, at the base of the second, substantially conical part 17, locally reducing the thickness of the first part 16 of the irradiation cell 7. FIG. 1 shows that this groove 11 is in direct communication with the annular channel 10 defined by the diffuser 14 around the outer surface of the first part 16. This makes it possible to evacuate the coolant in the annular channel 10 created by the diffuser 14. The circulation of a coolant in the annular groove 11 and the locally reduced thickness in the first part 16 of the irradiation cell 7 at the annular groove 11 enables improved cooling of the foil 4 closing the cavity 3.

The invention claimed is:

1. A device configured to produce radioisotopes by irradiating a target fluid using a particle beam, the target fluid comprising a radioisotope precursor, the device comprising:

an irradiation cell comprising:

a conical cavity configured to contain the target fluid, the cavity having an opening at a base of the conical cavity, where the cavity base is surrounded by a front surface of the irradiation cell; and a metal foil connected to the front surface of the irradiation cell and closing the opening of the cavity, wherein the metal foil has a diameter less than or substantially equal to a diameter of the cavity base, wherein an outer surface of the conical cavity comprises furrows extending from an area close to an apex of the conical cavity toward a region close to the base of the cavity, so as to create pathways for the passage of non-cryogenic coolant to flow along the outer surface;

a cooling device configured to circulate the non-cryogenic coolant and to cool the walls of the cavity; and an inclined surface, defining the bottom surface of the cavity, so as to evacuate the target fluid, which condenses in contact with the cavity walls, by gravity toward the metal foil;

wherein the inclined surface intersects a plane formed by the metal foil at an acute angle ($\alpha$) with the plane, so as to form, with the metal foil, a corner-shaped area that collects the evacuated target fluid, such that a height of the collected target fluid is maximal at the metal foil and decreases in a direction away from the metal foil.

2. The device according to claim 1, wherein the metal foil is positioned substantially perpendicular to an axis of the particle beam.

3. The device according to claim 1, wherein the radioisotopes are produced by irradiating a target fluid using a substantially horizontal particle beam.

4. The device according to claim 1, wherein a size of the acute angle ($\alpha$) is between 30° and 89°.

5. The device according to claim 1, wherein the cooling device comprises:

a coolant intake situated across from the part of the irradiation cell opposite the foil; and a diffuser creating a channel disposed to circulate the non-cryogenic coolant.

6. The device according to claim 1, wherein an apex of conical cavity is rounded.

7. The device according to claim 1, wherein the irradiation cell comprises:

a first part comprising a front surface, which forms a bearing surface for the metal foil, and a rear surface; and a second, substantially conical part, which protrudes relative to the rear surface of the first part;

wherein the cavity:

passes through the first part to extend into the second part, and forms, in the front surface of the first part, an opening defined by an edge, such that the metal foil closes the opening at the edge when the metal foil bears on the front surface of the first part.

8. The device according to claim 7, wherein the first part further comprises a groove surrounding the second part on a side of the rear surface, the groove being configured to collect the non-cryogenic coolant flowing along an outer surface of the second part.

9. The device according to claim 1, wherein the irradiation cell is made from niobium.

10. An irradiation cell configured to produce radioisotopes by irradiating a target fluid using a particle beam, the target fluid comprising a radioisotope precursor, the irradiation cell comprising:

a metal foil;

a first part comprising a front surface and a rear surface, the front surface forming a bearing surface for the metal foil;

a second, substantially conical part, which protrudes relative to the rear surface of the first part; and a substantially conical cavity, the cavity:

having a bottom surface defined by an inclined plane;

having an opening at a base of the conical cavity, where the cavity base is surrounded by a front surface of the irradiation cell;

being configured to contain the target fluid;

passing through the first part to extend into the second part; and running into the front surface of the first part at an acute angle ($\alpha$) to form in the first part the opening defined by an edge, wherein an outer surface of the second part comprises furrows extending from an area close to an apex of the second part toward a region near a base of the second part, so as to create pathways between the furrows for the passage of a non-cryogenic coolant flowing along the outer surface of the second part, and wherein the metal foil is:

connected to the front surface of the irradiation cell; and configured to close the opening at the edge when the metal foil bears on the front surface of the first part.

11. The irradiation cell according to claim 10, wherein the first part further comprises a groove, which, on a side of the rear surface of the first part, surrounds an outer surface of the second part, so as to reduce a thickness of the first part at the base of the second part, the groove being configured to collect the non-cryogenic coolant flowing along the outer surface of the second part.

12. The device according to claim 1, wherein the acute angle ($\alpha$) has a size of between 45° and 85°.

13. The device according to claim 1, wherein the acute angle ($\alpha$) has a size of between 60° and 85°.

14. The device according to claim 1, wherein the cavity comprises an inlet channel disposed proximal to the base of the cavity, the inlet channel being configured to introduce the target fluid into the cavity.

15. The device according to claim 1, wherein the inclined surface comprises an output channel disposed proximal to the base of the cavity, the output channel being configured to remove the collected target fluid.

16. The device according to claim 15, wherein the output channel is angled.

17. The device according to claim 1, wherein the cooling device comprises a diffuser forming an annular channel around the irradiation cell, the annular channel being configured to circulate the non-cryogenic coolant to cool walls of the cavity.

* * * * *